United States Patent [19]

Kaczperski

[11] Patent Number: 5,057,049

[45] Date of Patent: Oct. 15, 1991

[54] HEXAGONAL-SHAPED TOY BUILDING BLOCK

[76] Inventor: Thomas E. Kaczperski, 6383 Briggemen, St. Clair, Mich. 48079

[21] Appl. No.: 505,896

[22] Filed: Apr. 6, 1990

[51] Int. Cl.[5] ..... A63H 33/08

[52] U.S. Cl. ..... 446/128; 446/124

[58] Field of Search ..... 446/128, 118, 124, 117

[56] References Cited

U.S. PATENT DOCUMENTS

| | | | |
|---|---|---|---|
| D. 290,720 | 7/1987 | Bertrand . | |
| D. 295,993 | 5/1988 | Knudsen . | |
| D. 296,342 | 6/1988 | Knudsen . | |
| 3,233,358 | 2/1964 | Dehm | 446/128 |
| 3,487,579 | 1/1970 | Brettingen | 446/128 |
| 3,597,875 | 8/1971 | Christiansen . | |
| 4,030,236 | 6/1977 | Schnabel | 446/128 |
| 4,176,493 | 12/1979 | Dideriksen . | |
| 4,556,394 | 12/1985 | Chen . | |
| 4,740,189 | 4/1988 | Bertrand . | |
| 4,809,980 | 3/1989 | Bertrand . | |
| 4,883,440 | 11/1989 | Bolli . | |

FOREIGN PATENT DOCUMENTS

| | | | |
|---|---|---|---|
| 935308 | 8/1963 | Denmark | 446/128 |
| 908233 | 4/1954 | Fed. Rep. of Germany | 446/128 |
| 229861 | 1/1960 | Fed. Rep. of Germany | 446/128 |
| 355070 | 7/1961 | Fed. Rep. of Germany | 446/128 |
| 1916240 | 11/1969 | Fed. Rep. of Germany | 446/128 |

*Primary Examiner*—Robert A. Hafer
*Assistant Examiner*—David J. Kenealy
*Attorney, Agent, or Firm*—Harness, Dickey & Pierce

[57] ABSTRACT

A toy building block which interconnects with other like blocks or other commercially available toy building blocks. The blocks herein described provide for equidistant spacing among adjacent post members which upon interconnection allow blocks to form branched connections at almost any desired angle.

2 Claims, 2 Drawing Sheets

HEXAGONAL-SHAPED TOY BUILDING BLOCK

BACKGROUND OF THE INVENTION

This invention relates to a toy building element and particularly to a plastic element in which all adjacent post members are equidistantly spaced to be interconnected with other toy building elements of various shapes and sizes.

Many types of building elements are known, however, most of them are either rectangular or block-like in shape or are molded to form a particular design such as an airplane, boat or car. Other specifically shaped toy building elements are in existence but they are intended to be special attachment pieces and can not be used with like elements to form a recognizable design.

Except for a few specially shaped toy building elements, most toy building elements can only be attached in a linear manner or at right angles. This seriously limits the alternative designs available when interconnecting like elements.

SUMMARY OF THE INVENTION

In light of the disadvantages with the prior art, it is an object of the present invention to provide toy building elements that can be used with other elements embodying equidistantly spaced post members, or used with many of the other toy building blocks already on the market. According to the invention, the equidistantly spaced post members afford the user the opportunity to form virtually any shape desired.

For example, it is possible to interconnect two identical building elements having a hexagonal shape utilizing one of the outermost post members. When interconnection occurs between a single post member and a single recess, the two pieces can pivot together until a peripheral wall of the receiving element comes in contact with another post on the inserted element. Connection may also occur utilizing two post members wherein the resulting formation appears to be on a linear axis when viewed from the top. Another possibility utilizes four post members. When four post members are utilized the resulting formation appears topographically to be at a 45° angle. Lastly, two hexagonal-shaped building elements can directly overlap, in which case all six of the recesses on the receiving element are coacting with the six external most post members of the inserted element. Obviously, because of the equidistant spacing of the post members and the symmetry of a hexagonal shape, any of the above-mentioned formations could occur rotatably around the interconnected element.

It is also possible to interconnect two building blocks which are dissimilar in outer body shape where one of the blocks contains equidistantly spaced post members and the other block contains equidistantly spaced recesses in proportion to the spacing of the post members on the mating block.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
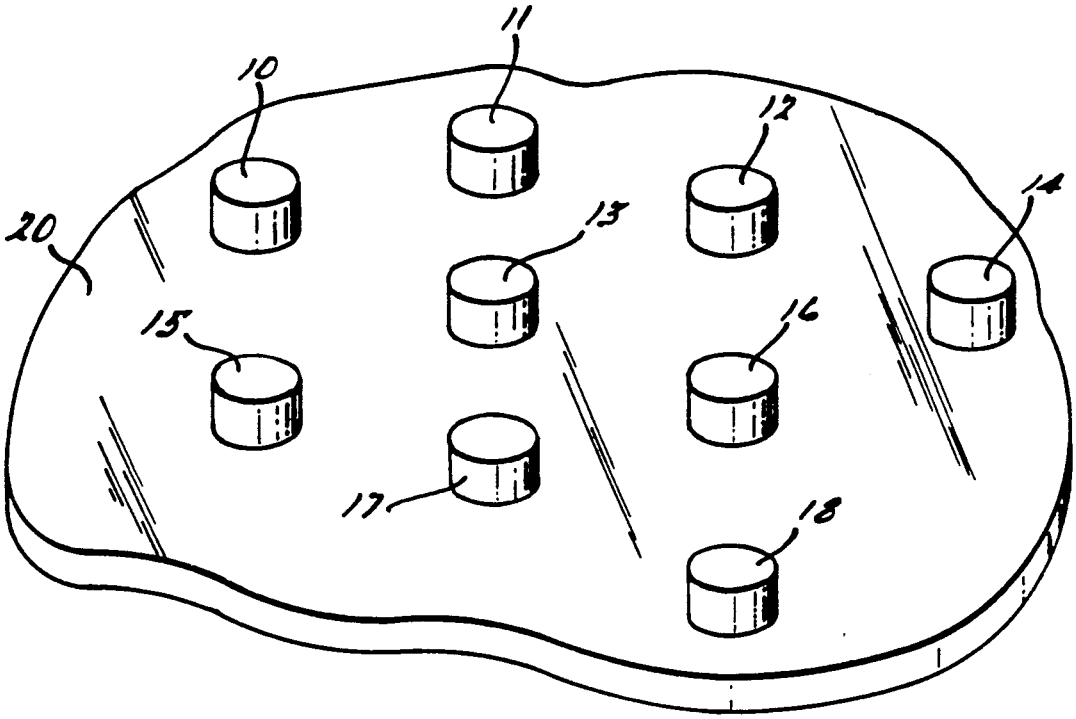
FIG. 1 is a perspective view of a building element having equidistantly spaced post members.

Referring to FIG. 1, a perspective view of a toy building element is disclosed. The toy building element is generally comprised of a plate portion (20) which hosts a plurality of post members (10–18). All post members (10–18) are arranged to be equidistantly spaced from all other adjacent post members. As a result of this equidistant spacing a maximum number of interconnections is possible.

Figure 2:
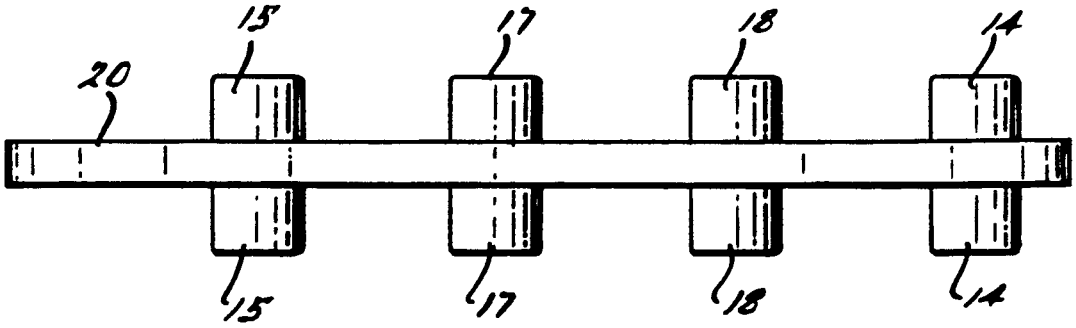
FIG. 2 is a cross-sectional view of one embodiment of the invention which contains a plurality of post members on more than one surface.

Referring to FIG. 2, a cross-sectional side view of the toy building element in FIG. 1 is disclosed. The toy building element demonstrates that a plurality of post members (10–18) can be found projecting out from different surfaces (20–22) on the same building element. The unique equidistant spacing of all adjacent post members allows the user to form branch connections at almost any angle desired.

Figure 3:
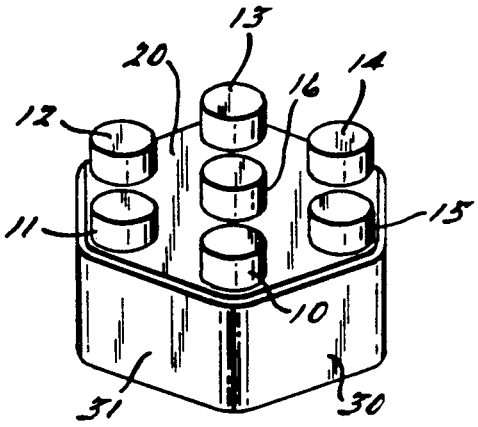
FIG. 3 is a perspective view of one embodiment of the invention having a hexagonal outer body shape.
Figure 4:
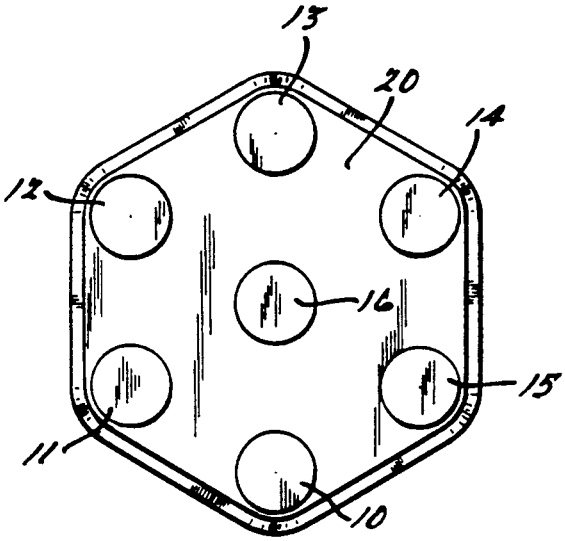
FIG. 4 is an elevational view of one embodiment of the invention having a hexagonal outer body shape.

Referring to FIGS. 3 and 4, one example of the one-piece toy building element has a hexagonal body portion comprised of six peripheral walls (30–35) and a top wall (20) which hosts the upwardly projecting posts (10–16). All posts are equidistantly spaced to provide the maximum number of interconnecting combinations. As a result of this spacing, two building elements can be combined using one post, two posts, four posts or six posts as a means of connection.

Figure 5:
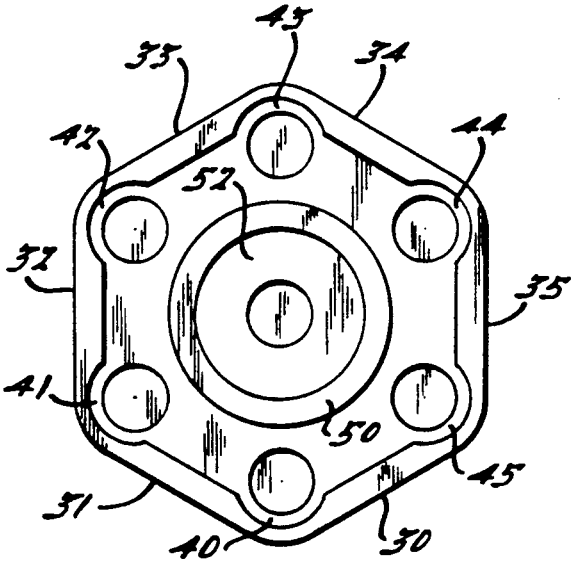
FIG. 5 is an underside view of the embodiment in FIG. 4.
Figure 6:
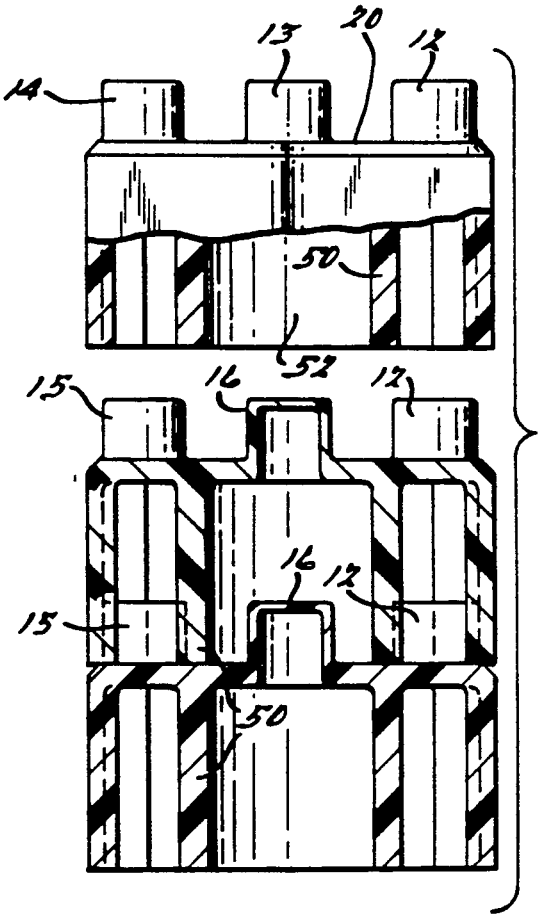
FIG. 6 is a cross-sectional frontal view of two interconnected hexagonal-shaped building elements in position to interconnect with a third hexagonal-shaped building element.

Referring to FIGS. 5 and 6, interconnection between two hexagonal building elements occurs as one or more posts are inserted into specially adapted recesses (40–45) contained on the inner surfaces of the peripheral walls (30–35). The recesses partially engulf inserted post members thereby preventing lateral movement between two interconnected elements. As the two hexagonal building elements are mated, the post of one element is inserted in the recess of another element until the basal portion of the peripheral walls (30–35) on the receiving element come in contact and rest upon the top wall (20) of the inserted element.

As a means of preventing further movement, a centrally located hollow cylinder (50) having a specific diameter projects downwardly from the inner surface of the top wall (20). The FIG. 4 cross-sectional view illustrates that the diameter of the cylinder is sufficient in area to tightly abut an inserted post member (10–16)l Also, the aperture portion (52) of the cylinder is sufficient in area to entertain a post member. When two of the hexagonal building elements are interconnected so that four or six of the posts on one element are engulfed by recesses (40–45) on the other, the aperture portion of the cylinder on the receiving element serves to accommodate a post member.

Those skilled in the art can now appreciate from the foregoing description that the broad teachings of the present invention can be implemented in a variety of forms. Therefore, while this invention has been described in connection with particular examples thereof and particularly with hexagonal-shaped pieces, the true scope of the invention should not be so limited since other modifications will become apparent to the skilled practitioner upon a study of the drawings, specification and the following claims.

What is claimed is:

1. A toy building element adapted to interconnect with other toy building elements, comprising means defining a relatively planar block structure, wherein said block structure hosts a plurality of equidistantly spaced adjacent post members, each post member projecting perpendicularly from said planar block structure and being generally cylindrical in shape said block structure has a hexagonal-shaped outer body portion and stabilizing means extending downwardly from an inner surface of a top base plate surface which abuts the surface of one or more inserted posts, said stabilizing means including a hexagonal skirt with a plurality of recesses surrounding a depending cylinder, said hexagonal skirt recesses and cylinder abutting posts inserting into said stabilizing means to secure the posts to said building element.

2. The toy building element according to claim 1, wherein said element has equidistant spacing between all adjacent post members of other like elements when stacked in a partially overlapping position to form a branched connection at a desired angle.

* * * * *